United States Patent [19]

Gentry

[11] Patent Number: 4,906,417

[45] Date of Patent: Mar. 6, 1990

[54] HUMIDIFIER

[75] Inventor: Jefferson Gentry, Chicago, Ill.

[73] Assignee: Associated Mills Inc., Chicago, Ill.

[21] Appl. No.: 348,157

[22] Filed: May 3, 1989

Related U.S. Application Data

[63] Continuation of Ser. No. 153,096, Feb. 8, 1988, abandoned.

[51] Int. Cl.[4] ..... B01F 3/04

[52] U.S. Cl. ..... 261/30; 128/203.26; 219/271; 261/142; 261/DIG. 65

[58] Field of Search ..... 261/1, 18.1, 22, 30, 261/81, 119.1, 91, 142, DIG. 17, DIG. 65; 122/233; 422/123, 124, 125; 128/200.16, 200.14, 200.25, 200.21, 203.26, 203.27; 219/271, 273, 275; 239/102.1, 302, 338, 214.11, 214.17, 214.25, 222.11

[56] References Cited

U.S. PATENT DOCUMENTS

| | | | |
|---|---|---|---|
| 2,847,734 | 8/1958 | Tauben | 219/271 X |
| 2,885,527 | 5/1959 | Tone et al. | 219/275 X |
| 3,098,926 | 7/1963 | Katzman | 219/275 |
| 3,319,046 | 5/1967 | Katzman | 219/275 |
| 3,610,879 | 10/1971 | Katzman et al. | 219/271 |
| 4,640,804 | 2/1987 | Mizoguchi | 261/81 |
| 4,724,104 | 2/1988 | Kim | 261/81 X |
| 4,752,422 | 6/1988 | Uchida et al. | 261/81 |
| 4,752,423 | 6/1988 | Wong | 261/81 X |

*Primary Examiner*—Richard L. Chiesa

*Attorney, Agent, or Firm*—Laff, Whitesel, Conte & Saret

[57] ABSTRACT

A humidifier has a cap which may be lifted off to wash it. The lift off cap is sealed to the humidifier by a labyrinth seal. A vapor well is formed in the top surface of said cap with a steam discharge nozzle directed over the well. The cap, and therefore, the nozzle and vapor well may rotate over a 360° traverse. The nozzle is formed by spaced inclined planes setting at angles in the range of 8°–30° and preferably 18° and 20°, respectively, the angles being taken with respect to the horizontal.

5 Claims, 1 Drawing Sheet

HUMIDIFIER

This is a continuation of application Ser. No. 153,096 filed Feb. 8, 1988, now abandoned.

This invention relates to humidifiers and more particularly to humidifiers which may dispense steam mixed with a medication or other vaporized substance.

Humidifiers of the inventive type are personal appliances which add moisture to the atmosphere inside a suitable enclosure, such as a sick room. Usually this is done by boiling water to create steam which is injected into a pressurized stream of air that is released in the room. Very often, it may be desirable to add a medication or another substance to the steam, usually by vaporization at a point which introduces it into a flowing air stream containing steam.

A number of considerations apply to the design of a personal appliance humidifier, such as ease of use, portability, reliability, survivability, a sealed reservoir, and the duration of a single operating cycle so that the humidifier may operate all night without requiring a refill, for example. The humidifier should also be easy to clean, should provide a controllable level of humidity, and should give a directional control over the area of coverage. The medication vaporizer should not add an awkwardness or complication to the design. The medication dispensing capabilities should continue for either as long as the steam is being generated or until a prescribed dosage is used and should be uniformly operative regardless of the direction in which steam is discharged.

SUMMARY OF INVENTION

Accordingly, an object of this invention is to provide new and improved humidifiers with vaporizing capabilities. In this connection, an object is to provide humidifiers which are capable of directing an air stream containing steam in virtually any direction, without an adverse effect upon the vaporization of medicine.

Another object of the invention is to provide a vaporizing humidifier with easy to clean parts which do not create an awkward or cumbersome device.

Still another object of the invention is to provide humidifiers with a controllable humidity which tends to also control the vaporization of medicine.

In keeping with an aspect of the invention, a humidifier has a relatively large opening for discharging steam. A cap is adapted to rest in the opening, with a labyrinth type of seal, to the humidifier housing. The cap may rotate throughout a 360° traverse to direct the steam through a discharge nozzle formed in the cap, a vapor well being located under and rotating with the nozzle discharge. The passageway leading to and forming the nozzle has a number of deflecting surfaces which cooperate to direct the stream of steam in a given upward direction. As the steam exits the nozzle, it passes over the vapor well formed in the cap to vaporize any medication contained therein. Thus, as the cap rotates, both the nozzle and the vapor well rotate as an integral unit so that the rotation has no effect upon the vaporization process. For cleaning purposes, the cap may be removed by lifting off and washing or even placing it in a dishwasher, if desirable.

BRIEF DESCRIPTION OF DRAWINGS

The principles of the invention may be understood best by a reading of the following specification and studying the attached drawing, in which.

DETAILED DESCRIPTION OF DRAWINGS

Figure 1:
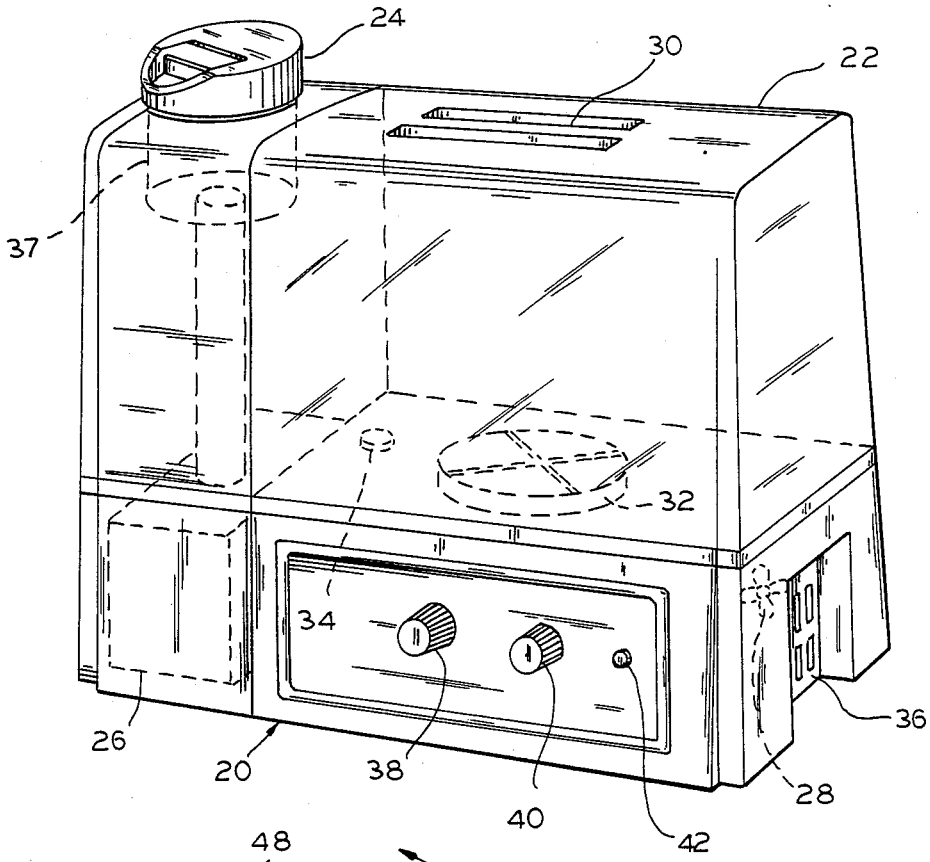
FIG. 1 is a perspective view of a humidifier incorporating the principles of the invention.

FIG. 1 shows a humidifier comprising a base unit 20, a water reservoir 22, and a cap 24 having a vapor well and nozzle. The base unit 20 includes a steam generating chamber 26 for converting water taken from reservoir 22 into steam and a fan 28 for driving an air stream containing the steam out of the humidifier under pressure sufficient to project the air stream across a substantial distance.

The reservoir 22 has a handle 30 for easy lifting, assembly and disassembly from the base unit 20, and for handling during cleaning. The bottom of the reservoir housing includes a fill cap 32 which is large enough for access for cleaning or filling with water. The fill cap 32 has any suitable gasket means for sealing the reservoir 22 so that it will not leak when it is inverted and installed on the base 20.

A suitable water valve 34 is positioned in the bottom of the reservoir 22 to enable a metered or limited flow rate of water to exit the reservoir and to enter the steam chamber 26.

The fan 28 drives a stream of air which enters air holes 36, moves through the steam chamber 26, mist chamber 37, and out the nozzle in cap 24. The fan is preferably near air holes 36 and in the cool end of the air duct.

A first knob 38 controls a humidistat which detects ambient humidity, automatically switching the humidifier off and on while it is operating to maintain a suitable range of operations within the humidified area. A second knob 40 switches the humidifier off and on and adjusts fan speed to control the intensity of the mist delivered by the air stream issuing from the nozzle in cap 24. A pilot lamp 42 indicates whether the humidifier is switched off or on.

In operation, a user grasps handle 30 and lifts the reservoir 22 off the base 20. The reservoir 22 is inverted and fill cap 32 is removed. The reservoir 22 is filled by running water through the fill opening when the cap 32 is removed. After the reservoir is filled to a suitable level, the fill cap 32 is replaced. Then, the reservoir is set on base 20, with valve 34 suitably located over the base 20 to deliver water at a metered rate to the steam generator 26. The humidistat 38 is set to a desired ambient humidity. The humidifier is switched on by a rotation of the knob 40, and the fan speed is adjusted to a desired level.

Figure 2:
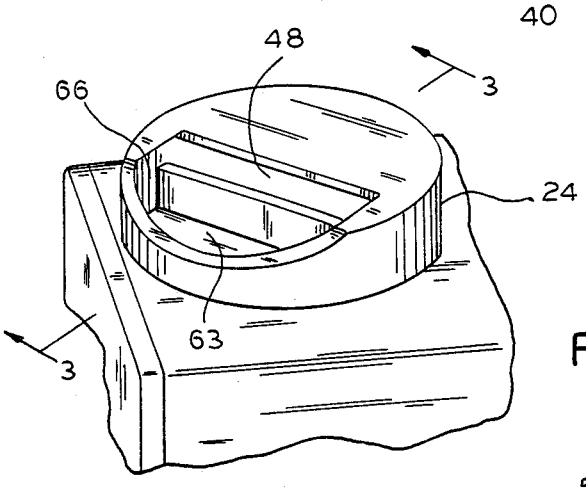
FIG. 2 is a perspective view which shows details of the inventive vapor well and nozzle cap.
Figure 3:
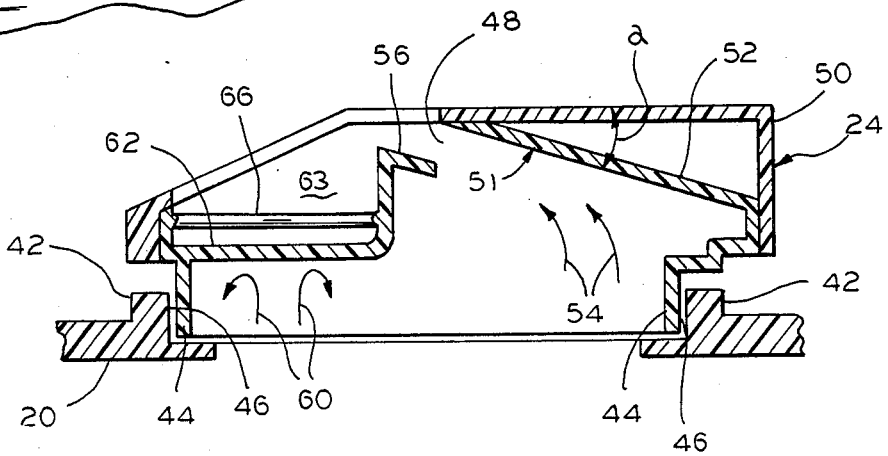
FIG. 3 is a cross section of the vapor well and cap taken along line 3—3 of FIG. 2.

The cap 24 (FIGS. 2, 3) simply sets on the top of the housing of base 20. There is no need for screw threads or gasket sealing since no substantial amount of relatively high pressure appears at this point. However, there is a certain amount of augmented pressure from the fan 28 blowing the air stream. This amount of pressure may be contained by a labyrinth seal formed by an upstanding collar 42 (FIG. 3) on the top of housing 20 and by a depending collar 44 on the bottom of cap 24. For the steam to escape from under the cap, it would have to pass through a tortuous path 46 between the collars 42, 44. Considering the amount of steam which may escape through the nozzle opening 48 and the pressure which builds within the mist chamber 37 (FIG. 1) beneath the nozzle, almost none of the stream will pass through the tortuous path 46 between the collars 44, 46 (FIG. 3).

The cap 24 is made from two piece parts, one of which forms a decorative cover 50. The second piece part 51 is bonded to the inside of the part 50, and includes an inclined plane 52 which guides and directs an air stream 54 containing steam toward a nozzle 48, under the force of the fan 28 (FIG. 1). Formed on the second piece part 51, a second inclined plane 56 is positioned opposite and in a spaced parallel relationship to the inclined plane 52 in order to help direct the air stream 54 which is issuing from or passing out of the nozzle 48. As a result, the air stream issuing from the nozzle 48 is fairly well defined and is directed upwardly at an angle which is set by the two inclined planes.

The rising air stream 60 strikes and is deflected by the bottom of a flat surface 62, heating it in the process. The flat surface 62 is the bottom of a vapor well 63 formed in the cap 24. Any suitable medicine or other substance may be poured into this well. One or more suitable ridges 66 may be molded in the vertical walls of the vapor well to provide a fill line which defines how much medicine to place in the well. The heat on the bottom of the flat surface 62, and the ambient heat of the air stream 54 containing steam issuing from nozzle 48, vaporizes the medicine which mixes into the air stream.

Figure 4:
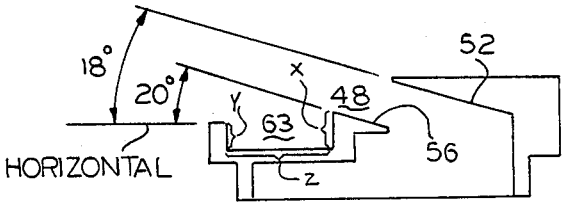
FIG. 4. is a schematic showing the angles of a nozzle structure used for vaporizing a medicine.

The critical features of the nozzle construction are best seen in FIG. 4, for one specific embodiment. The upper inclined plane 52 is preferably set at an angle of 20°, thereby giving a nozzle aperture which is closing toward its exit end at an angle of 2°. In this embodiment, the rear wall of the vapor well (distance X) is one-half inch high. The front wall of the vapor well (distance Y) is three-eighths of an inch high. The maximum distance from the rear wall to the front wall (distance Z) is one and one-eighth of an inch.

These dimensions are optimum for the embodiment described herein. If the angles are more than 10° greater than those shown and described, the mist of the solution vaporized from well 63 will not atomize. If the angles are more than 10° less than those shown and described, the output mist (steam) condenses in the vapor well and defeats the humidifying purpose of the appliance. Thus, the operative angles should fall within the range of 8°–30° for plane 52 and 10°–30° for plane 56.

Since cap 24 merely sets inside collar 42 and is not attached by any screw threads, or the like, it is free to rotate 360° so that the air stream containing the steam may be aimed in any suitable direction. The nozzle and the vapor well rotate as a unit so that vaporization is not affected by the direction in which the air stream is discharged.

Those who are skilled in the art will readily perceive how to modify the invention. Therefore, the appended claims are to be construed to cover all equivalent structures which fall within the true scope and spirit of the invention.

The claimed invention is:

1. A humidifier comprising a source of steam, a mist chamber removable rotatable a lift-off cap which is free of attachments and which has an upper surface and contains a nozzle, said cap setting freely on said humidifier above said mist chamber for a rotation about a 360° C. traverse, means for directing an air stream containing said stream from said source toward said cap and through said nozzle to there exit said humidifier, said cap having a pair of internal inclined planes for guiding and directing said air stream out said nozzle at an angle which is inclined upwardly at an angle of substantially 8°–28° with respect to horizontal, said two planes slightly converging in the direction of said nozzle, a labyrinth seal surrounding said cap to contain said stream in said mist chamber, said cap having a circular base for enabling it to rotate endlessly within said labyrinth seal and a medication vapor well for containing a medication substance unitarily formed on and within said upper surface of said cap and positioned in front of and beneath said nozzle, said vapor well having a bottom surface which is impinged on its underside by said air stream to vaporize any of said medication substance which may be contained therein by the heat of the steam in said air stream issuing from said nozzle, whereby said nozzle and vapor well move as a unit through said 360° C. traverse to direct a medicated mist along any azimuth about said 360° C. traverse and whereby said cap can be removed by simply lifting it off for easy cleaning.

2. The humidifier of claim 1 wherein said cap includes two piece parts one of said piece parts forming said vapor well and extending to a first of said pair of planes inclined at an angle of about 20 and terminating at an elevated edge of said well, said first inclined plato extending away from said elevated edge of said well and said nozzle, and a second of said pair of planes inclined at an angle of about 18° and extending from an opposite side of said cap toward said well and in a spaced relationship to said first inclined plane, thereby defining between them a nozzle orifice extending upwardly with said plane converging toward each other at an angle of about 2°, the second of said piece parts being a decorative cap bonded to and covering said first piece part.

3. The humidifier of claim 2 and indicia means marking on a well of said vapor well to identify a specified amount of substance to be deposited in sad well for vaporization.

4. The humidifier of claim 1 wherein said underside of said vapor well is shaped and dimensioned to vaporize any substance in said well in response to heat in said air stream.

5. The humidifier of claim 1 and a removable reservoir positioned to rest on a base of said humidifier, and valve means for delivering water at a metered rate from said reservoir to said steam generator.

* * * * *